US007418762B2

(12) United States Patent
Arai et al.

(10) Patent No.: US 7,418,762 B2
(45) Date of Patent: Sep. 2, 2008

(54) SELF-PROPELLED CLEANING DEVICE AND CHARGER USING THE SAME

(75) Inventors: Yutaka Arai, Chiyoda (JP); Yuuji Hosoda, Chiyoda (JP); Saku Egawa, Toride (JP); Hiroyuki Sadamori, Chiyoda (JP); Hirofumi Tanaka, Shiroyama (JP); Wataru Yamamoto, Hitachi (JP); Taiji Tajima, Tsukuba (JP); Makoto Hattori, Chiyoda (JP)

(73) Assignees: Hitachi, Ltd., Tokyo (JP); Hitachi Home & Life Solutions, Inc., Tokyo (JP)

( * ) Notice: Subject to any disclaimer, the term of this patent is extended or adjusted under 35 U.S.C. 154(b) by 749 days.

(21) Appl. No.: 10/791,775

(22) Filed: Mar. 4, 2004

(65) Prior Publication Data

US 2004/0255425 A1 Dec. 23, 2004

(30) Foreign Application Priority Data

Mar. 5, 2003 (JP) ..... 2003-057917

(51) Int. Cl.
*A47L 9/28* (2006.01)

(52) U.S. Cl. ..... 15/319; 15/323; 15/339; 15/340.1

(58) Field of Classification Search ..... 15/319, 15/323, 339, 340.1, 340.3; 439/660, 919; 180/169; 700/258, 259; 701/23; *A47L 9/28*
See application file for complete search history.

(56) References Cited

U.S. PATENT DOCUMENTS

2002/0124343 A1* 9/2002 Reed ..... 15/319

FOREIGN PATENT DOCUMENTS

| | | |
|---|---|---|
| JP | 8-83125 | 3/1996 |
| WO | 00/36961 | 6/2000 |
| WO | 02-067745 | 9/2002 |

* cited by examiner

*Primary Examiner*—David A Redding
(74) *Attorney, Agent, or Firm*—Antonelli, Terry, Stout & Kraus, LLP.

(57) ABSTRACT

A self-propelled cleaning device having a cylindrical side cover has a suction body capable of moving transversely to the forward direction. The side cover is held by a base via a suspension. When cleaning corners of a room, the suction body moves by a wall and as the suction body moves to a corner, the movement amount of the suction body is changed. When an obstacle touches the cleaning device, the side cover moves, and the article touches a side cover switch, and the direction of the article is detected.

3 Claims, 9 Drawing Sheets

SELF-PROPELLED CLEANING DEVICE AND CHARGER USING THE SAME

BACKGROUND OF THE INVENTION

1. Field of the Invention

The present invention relates to an electric cleaning device and a charger used for it and more particularly to a self-propelled cleaning device automatically movable and a charger used for it.

2. Prior Art

An example of a conventional free-running electric cleaning device is described in Patent Document 1 (Japanese Patent Application Laid-Open Announcement 2002-532177). The electric cleaning device described in this patent application has a body provided with each support wheel, a drive means for driving wheels of the electric cleaning device so as to move a cleaning surface in the forward direction, a dust separator, and a fan for pulling air into the dust separator. And, to enable cleaning in contact with a wall, a head of the cleaning device is mounted so as to cross the forward direction and is projected at least on one side of the body. When there is an obstacle found, the projected head can be pulled into the body.

Another example of a conventional free-running cleaning device is described in Patent Document 2 (Japanese Patent Application 8-83125).

The robot cleaning device described in this patent application, to automatically charge a battery when it is consumed, has a charging level detection means for detecting that the charging level of the battery is lower than the a predetermined level, a power supplier for supplying the power to the battery, and a power input means for electrically connecting the power supplier and battery.

Still another example of a conventional free-running cleaning device is described in Patent Document 3 (International Patent Application 02/067745 Pamphlet).

The robot cleaning device described in this patent document has a chassis provided with a front bumper and at least two drive wheels. The front bumper can move for the chassis and the robot cleaning device detects the movement of the chassis and front bumper and when the front bumper encounters an obstacle, transmits a control signal to a guide control system. By doing this, even if there is an obstacle, the guide control system can operate the robot cleaning device round the obstacle.

The free running electric cleaning device described in Patent Document 1 does not have a means from detecting the projection amount of a suction body and a means for controlling the suction body on the basis of the position relationship between a wall and the cleaning device body, so that there is the possibility that in the corners of a room, there may be left unsucked dust. Further, the suction body is pressed against the wall by a spring, so that a rubbed mark is caused onto the wall.

Further, in the free running electric cleaning device described in Patent Document 2, when a dust collection case is full of sucked dust, dust must be dumped by hand. Therefore, in a self-propelled cleaning device whose capacity is limited, dust must be disposed frequently, so that it is difficult to completely automate the cleaning device. Furthermore, in the self-propelled cleaning device described in Patent Document 3, only an obstacle in front of the self-propelled cleaning device can be detected, so that to move backward, the direction must be changed.

The present invention was developed with the foregoing fault of the prior art in view and an object of the present invention is to provide a self-propelled cleaning device capable of cleaning the neighborhood of a wall and furniture including the corners of a room. Another object of the present invention is to miniaturize the self-propelled cleaning device. Still another object of the present invention is to automate the charging operation of the self-propelled cleaning device. And, the present invention is intended to accomplish at least any of the objects.

The characteristic of the present invention for accomplishing the above objects is that a self-propelled cleaning device having a loaded power source capable of automatically moving has a circular side cover and a suction body which can be stored in this cylindrical cover and can move transversely to the forward direction and the suction body can move over the maximum width of the cleaning device.

And, in this characteristic, it is preferable to install a base for holding the power source, a suspension for elastically supporting the side cover by the base, and detection means which are positioned at a plurality of parts in the peripheral direction of the side cover so as to detect the movement direction of the side cover. Further, it is preferable to install a fan which is arranged in the cleaning device and sucks in air including dust from the suction body, a first dust collection case for collecting dust in air which is sucked by the fan, a switchable shutter installed on the outer wall of the dust collection case, and a guide means for connecting the first dust collection means and a second dust collection means arranged outside the cleaning device and to move dust collected in the first dust collection means to the second dust collection means and it is possible to install charging terminals for supplying power from an external power source on the power source and can move dust from the first dust collection means to the second dust collection means during charging the power source.

Another characteristic of the present invention for accomplishing the above objects is that in the self-propelled cleaning device having the suction body for sucking in dust, the dust collection case for collecting dust sucked from the suction body, a detection means for detecting an article around the cleaning device, and a control means for controlling the moving direction of the cleaning device on the basis of the output of the detection means, the suction body can be stored in the cleaning device, and a moving means for moving the suction body transversely to the forward direction and an air tight means for holding the dust collection case air tightly even if the suction body is moved by the moving means are installed, and the dust collection case and suction body can be slidden.

And, in this characteristic, the moving means, when moving the cleaning device by the wall, can move the suction body over the width of the cleaning device and the control means preferably controls the suction body so as to move at a predetermined distance from the wall or in contact with the wall on the basis of the output of the detection means. Further, when moving the cleaning device by the wall, the moving means can move the suction body over the width of the cleaning device and it is desirable to install a means for returning the moved suction body on the cleaning device side.

Still another characteristic of the present invention for accomplishing the above objects is that the power source used in the self-propelled cleaning device has a power supply means for supplying power from a commercial power source to the power source loaded in the self-propelled cleaning device, a first contact for electrically connecting the power supply means and self-propelled cleaning device, and a guide means for guiding the self-propelled cleaning device when connecting a second contact of the self-propelled cleaning device to the first contact and additionally has an input means for inputting an operation instruction to the self-propelled cleaning device and a means for transferring the operation instruction inputted from the input means to the self-propelled cleaning device.

A further characteristic of the present invention for accomplishing the above objects is that the power source used in the self-propelled cleaning device has a power supply means for supplying power from a commercial power source to the power source loaded in the self-propelled cleaning device, a first contact for electrically connecting the power supply means and self-propelled cleaning device, a guide means for guiding the self-propelled cleaning device when connecting a second contact of the self-propelled cleaning device to the first contact, a suction means and a dust collection means for moving dust collected in the dust collection case possessed by the self-propelled cleaning device or a storage unit for storing the self-propelled cleaning device, and a detection means for detecting entry of the cleaning device into the storage unit and a display means for displaying entry thereof.

And, in this characteristic, the cleaning device has a control means for controlling the suction means and the control means may control the suction means so as to operate when the power supply means is in operation.

DESCRIPTION OF THE INVENTION

Figure 1A:
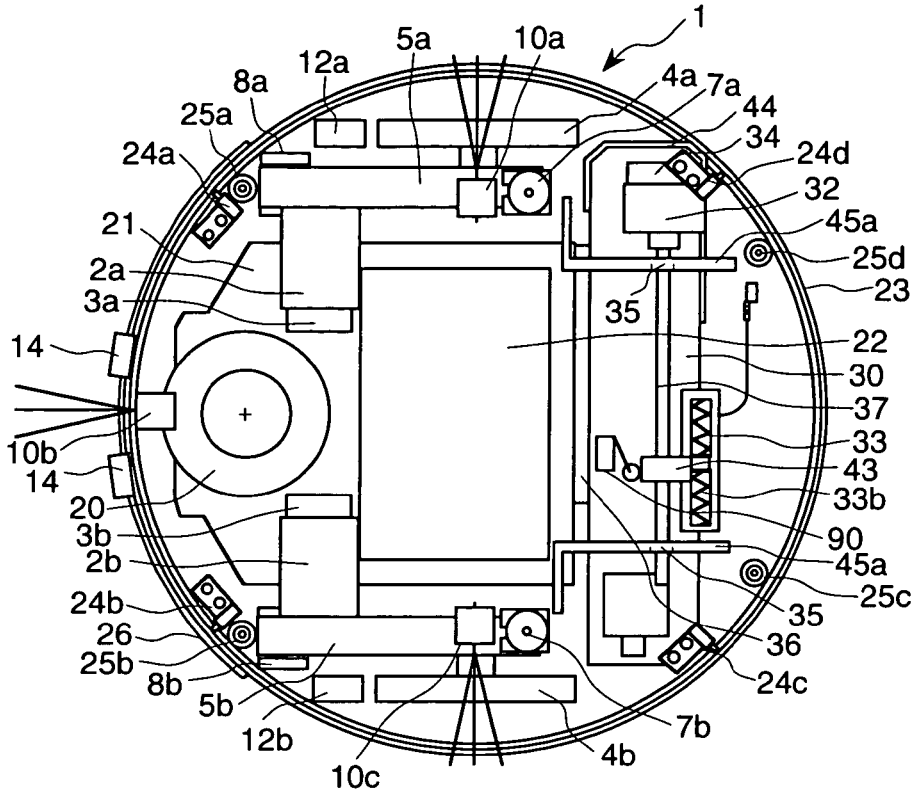
FIG. 1 is a top cross sectional view and a side cross sectional view of an embodiment of the self-propelled cleaning device relating to the present invention.
Figure 1B:
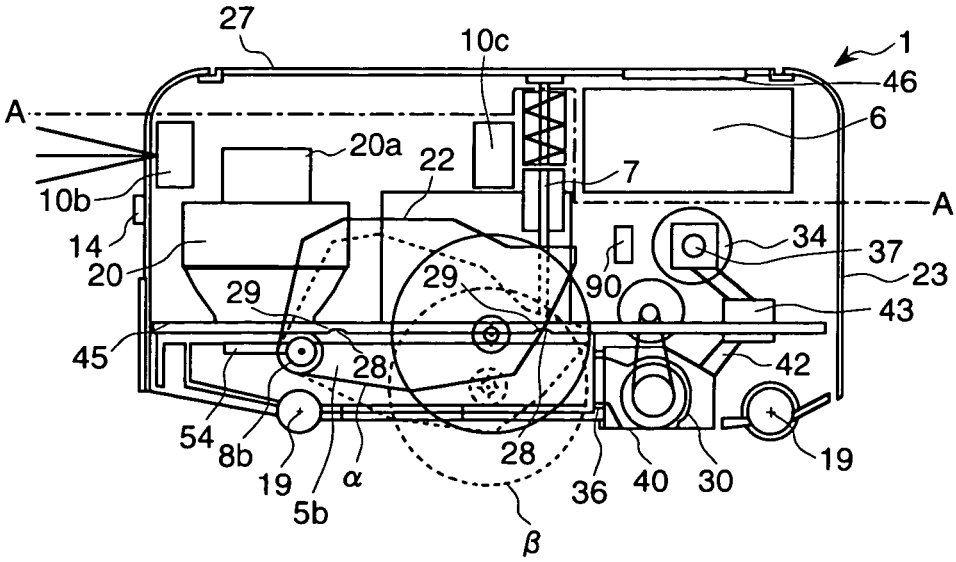

An embodiment of the self-propelled cleaning device system relating to the present invention will be explained with reference to FIGS. 1 to 8. The self-propelled cleaning device system has a cleaning device 1 freely running and cleaning dust and a charger 200 for supplying power to a storage battery 22 possessed by the cleaning device 1. FIG. 1 shows a cross sectional view of the self-propelled cleaning device 1. FIG. 1(*a*) is a cross sectional view along the line A-A shown in FIG. 1(*b*) and FIG. 1(*b*) is a longitudinal cross sectional view. The moving direction of the cleaning device 1 is the leftward direction of FIG. 1.

The structure of the self-propelled cleaning device 1 is formed in an almost cylindrical shape by a top cover 27 and a side cover 23. On both sides of the lower part in the cleaning device 1, a pair of drive wheels 4*a* and 4*b* for moving are mounted. The drive wheels 4*a* and 4*b* are individually driven by motors 2*a* and 2*b* mounted on the base. Speed reducers 5 for slowing down the output of the motors 2*a* and 2*b* are mounted on the motors 2*a* and 2*b*.

At the ends of the revolving shafts of the left and right motors 2*a* and 2*b* for moving, encoders 3*a* and 3*b* are mounted. The encoders 3*a* and 3*b* output the rotational speeds of the motors 2*a* and 2*b* for moving to a controller 6 mounted at the upper back part in the cleaning device 1. The controller 6 controls individually the voltages to be applied to the motors 2*a* and 2*b* for moving. The controller 6 feeds back and controls the rotational speeds of the motors 2*a* and 2*b* for moving which are detected by the encoders 3*a* and 3*b* and controls the rotational speeds of the drive wheels 4*a* and 4*b*.

To control the forward direction, the paired motors 2*a* and 2*b* are rotated at the same rotational speed and in the same direction, thus the cleaning device 1 is moved linearly. Further, the motors 2*a* and 2*b* are rotated at the same rotational speed and in the opposite directions, thus the cleaning device 1 is rotated at the place.

Hinge pins 8*a* and 8*b* support the speed reducers 5*a* and 5*b* rotatably round the horizontal shafts crossing at right angles to the forward direction. The speed reducers 5*a* and 5*b* are connected to the upper part of the cleaning device 1 via suspensions 7*a* and 7*b*. When the speed reducers 5*a* and 5*b* rotate round the hinge pins 8*a* and 8*b*, the drive wheels 4*a* and 4*b* move almost vertically. When the cleaning device 1 is put on the floor, the springs of the suspensions 7*a* and 7*b* shrink most due to the own weight of the cleaning device 1. The drive wheel 4*b* and the speed reducer 5*b* are positioned at the position (α) indicated by a solid line in FIG. 1(*b*). When the cleaning device 1 is lifted up, the springs of the suspensions 7*a* and 7*b* are stretched and the speed reducers 5*a* and 5*b* and the drive wheels 4*a* and 4*b* are moved at maximum up to the position (β) indicated by a dashed line in the drawing. By doing this, even if the floor surface whereon the self-propelled cleaning device 1 moves is uneven, the drive wheels 4*a* and 4*b* can be surely grounded.

Figure 2A:
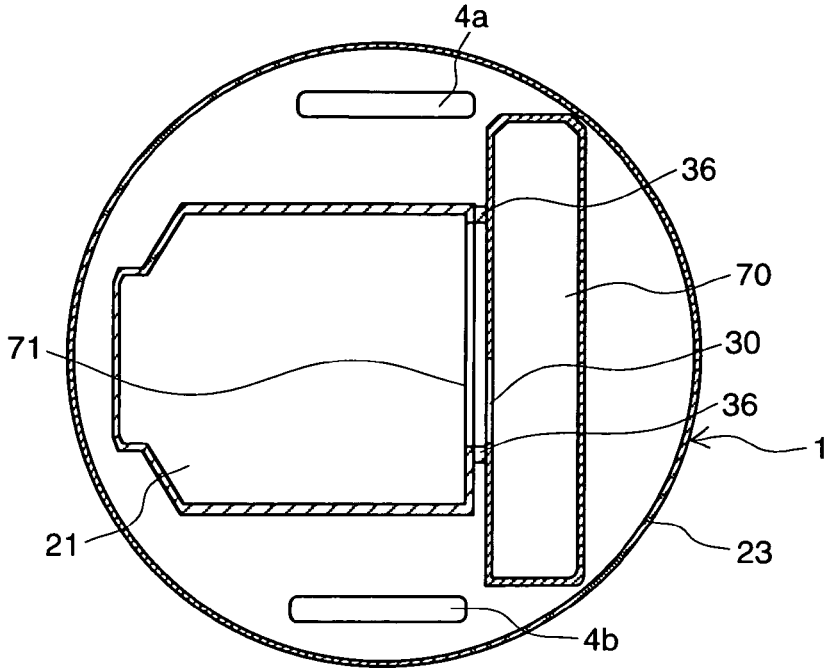
FIG. 2 is a drawing for explaining the movable range of the movable body used in the self-propelled cleaning device shown in FIG. 1.
Figure 2B:
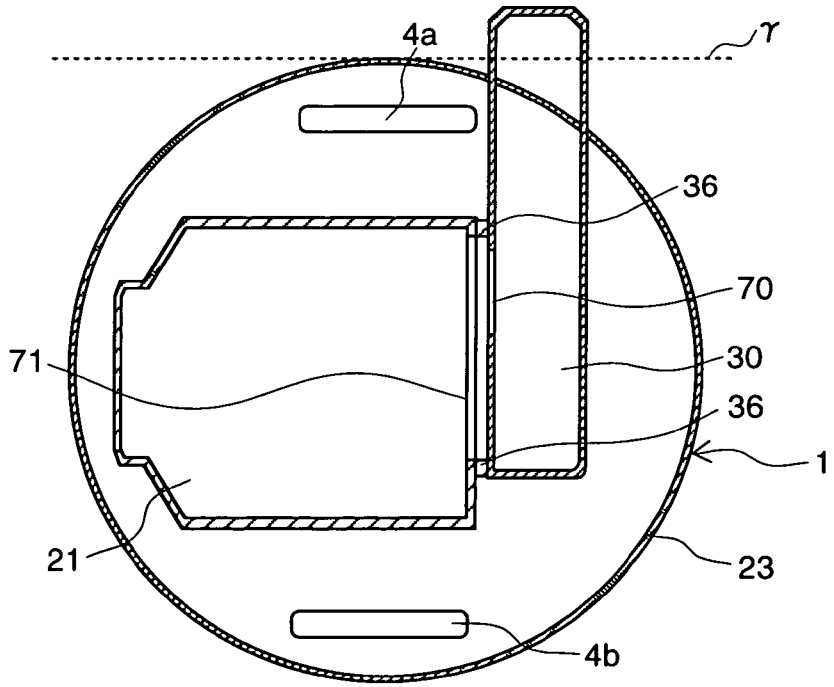

On the back side of the cleaning device 1 in the forward direction, a suction body 30 movable in the transverse direction is mounted. The movement situation of the suction body 30 will be explained by referring to FIG. 2. As shown in FIG. 2(*a*), the suction body 30 is stored in the cleaning device 1 during the general operation. In this state, the structure of the self-propelled cleaning device 1 is almost cylindrical. Since the structure of the self-propelled cleaning device 1 is cylindrical, when the cleaning device 1 is not in contact with an obstacle, it can rotate at the place free of obstruction. Therefore, the cleaning device 1 can optionally change the direction.

Further, the structure of the self-propelled cleaning device 1 is not limited to the cylindrical shape and any rounded shape such as a semispherical shape or a cut-head conical shape is acceptable. Even in any of these shapes, the cleaning device 1 can rotate free of obstruction of an obstacle to change the forward direction.

When the suction body 30 is positioned in the cleaning device 1, the suction body 30 cannot reach the neighborhood of the wall. In this case, as shown in FIG. 2(*b*), the tip of the suction body 30 is projected outside the right end (line γ) of the cleaning device 1 within the movable range of the suction body 30. By doing this, the tip of the suction body 30 reaches the neighborhood of the wall.

At the center of the self-propelled cleaning device 1, the storage battery 22 is loaded to supply power to each unit. The storage battery 22 is a nickel-hydrogen cell. The voltage of the storage battery 22 is detected by a detection circuit installed in the controller 6. The controller 6 monitors the detected voltage output and successively confirms the storage amount of electricity. On the front surface of the cleaning device 1, charging terminals 14 are mounted. When a specified voltage is applied to the charging terminals 14, the storage battery 22 in the cleaning device 1 is charged.

Figure 3:
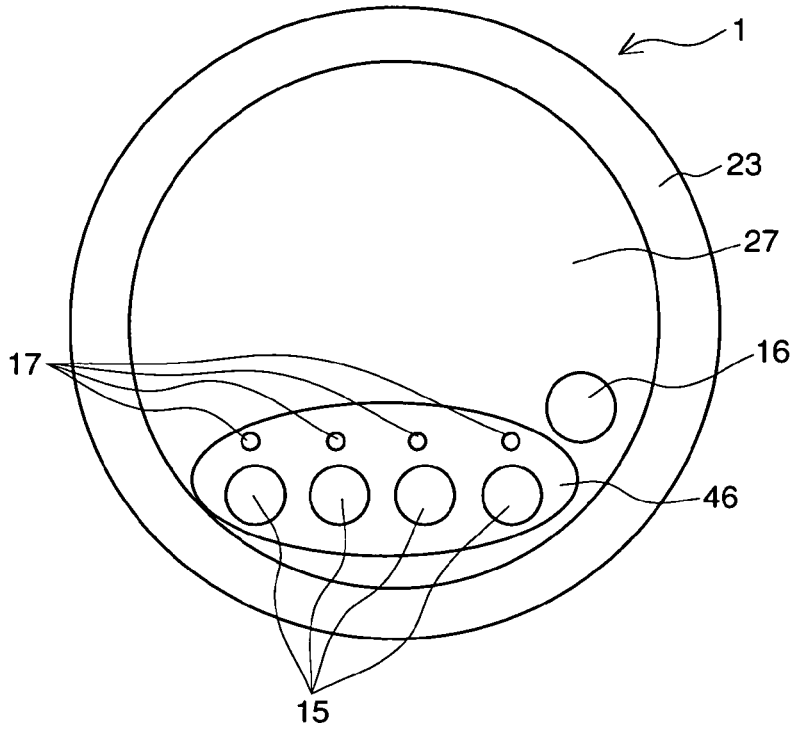
FIG. 3 is a top view of a top cover used in the self-propelled cleaning device shown in FIG. 1.
Figure 5:
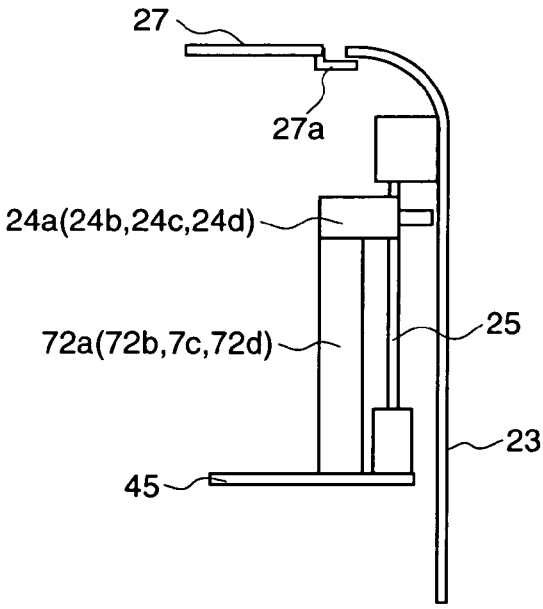
FIG. 5 is a partial longitudinal cross sectional view of the self-propelled cleaning device shown in FIG. 1.

On the upper part of the cleaning device 1, the cover 27 is mounted. The cover 27 will be shown in detail in FIG. 3. FIG. 3 is a top view of the cleaning device 1 and the upper side of the drawing is the forward direction. On the back side in the forward direction, an operation panel 46 having a plurality of switches 15, 15,—is mounted. The switches 15 are used to turn on or off the power source and to output a manual instruction to the self-propelled cleaning device 1. On the operation panel 46, an indicator 47 of a light emission diode is mounted. The indicator 47 indicates that the power source is turned on or off and the residual amount of the storage battery 22. The indicator 47 may use a liquid crystal display.

On the top cover 27 in the neighborhood of the operation panel, an infrared remote control receiver 16 is mounted. The receiver 16 is used to receive a signal from an infrared remote control transmitter 100 not shown in the drawing which is installed externally. On the basis of the signal received by the receiver 16, the cleaning device 1 moves forward or backward or rotates and the dust collection fan starts or stops. Further, the automatic cleaning operation is started or stopped.

On the outer peripheral part of the cleaning device 1, the cylindrical side cover 23 is arranged. The upper part of the side cover 23 is curved inward and at its end, the joint with the top cover 27 is formed. Inside the side cover 23 in the neighborhood of the side cover 23, infrared distance sensors 10*a* to 10*c* are arranged. The infrared distance sensors 1*a* to 10*c* measure the distances up to articles positioned on the fronts of the sensors 10*a* to 10*c*. Output signals from the sensors 10*a* to 10*c* are monitored by the controller 6. The parts of the side cover 23 opposite to the light receptors of the infrared distance sensors 10*a* to 10*c* are made of a material transmitting infrared light. Therefore, the distance between the self-propelled cleaning device 1 and a neighboring article can be recognized by the controller 6.

In the cleaning device 1, a gyro-sensor not shown in the drawing is mounted. The gyro-sensor outputs the angular speed of the self-propelled cleaning device round the shaft in the vertical direction to the controller 6. By doing this, even if the drive wheels 4*a* and 4*b* slip on the floor, the angular speed of the self-propelled cleaning device 1 can be detected.

On the lower part of the cleaning device 1 on both sides of the front, level difference sensors 12*a* and 12*b* are mounted downward. The level difference sensors 12*a* and 12*b* are reflection type infrared distance measuring sensors and output the existence of an article within the range at a predetermined distance from the light receptors of the sensors 12*a* and 12*b*. By doing this, even if the floor in the forward direction of the self-propelled cleaning device 1 is hollow, the sensors can detect it. When the level difference sensor 12*a* or 12*b* detects a level difference when the cleaning device 1 is moving, it stops the cleaning device 1 once. And, the cleaning device 1 changes its direction to the direction free of a level difference. By doing this, the cleaning device 1 is prevented from falling in the level difference. For the level difference sensors 12, in addition to the infrared sensors, ultrasonic sensors or contact switches can be used.

The dust collection structure in the cleaning device 1 will be explained in detail below. In the neighborhood of the suction body 30 movable in the transverse direction, a dust collection case 21 is installed. As shown in FIG. 2, in the face of the suction body 30 which is in contact with the dust collection case 21, a hole 70 is bored. Also in the face of the dust collection case 21 which is in contact with the suction body 30, a hole 71 is bored. Through the holes 70 and 71 bored in the suction body 30 and the dust collection case 21, air including dust which is sucked in by the suction body 30 passes.

Around the hole 71 formed in the dust collection case 21, a packing 36 is mounted. The packing 36 is used to keep between the suction body 30 and the dust collection case 21 air-tight. The surface of the part of the packing 36 in contact with the suction body 30 is processed smoothly.

On a base 45, a dust collection fan 20 is mounted. On the bottom side of the base 45, the dust collection case 21 is held. The dust collection fan 20 is connected to the dust collection case 21 via the base. In the connection part of the base 45 between the dust collection case 21 and the dust collection fan 20, an intake air ventilation hole is bored. In the state that the dust collection case 21 is mounted on the cleaning device 1, a packing not shown in the drawing keeps the flow path air-fight.

On the part of the dust collection case 21 opposite to the dust collection fan 20, a non-woven filter 54 is mounted. Due to the pressure difference caused by the operation of the dust collection fan 20, air including dust is sucked in from the suction body 30. Air including dust moves to the dust collection fan 20 from the suction body 30 through the dust collection case 21. And, dust and air are separated by the dust collection filter 54 and separated dust is collected in the dust collection case 21.

The holes 70 and 71 are respectively bored in the suction body 30 and the dust collection case 21 to form a wind path, so that the suction body 30 can move transversely by sliding on the packing 36 on the dust collection case 21 (refer to FIG. 2). Therefore, no hose and pipe are required and the cleaning device 1 can be miniaturized. Compared with the case that the dust collection case 21 and the suction body 30 are moved together with each other, the moving part can be lightened and the force required to move the suction body 30 can be made smaller. As a result, the drive device for moving the suction body 30 in the transverse direction can be miniaturized. The movable range of the suction body 30, as shown in FIG. 2(*b*), is the range that the hole 70 of the suction body 30 is not projected from the range surrounded by the packing 36 when the suction body 30 is most projected and the range that the left end of the suction body 30 does not move beyond the left end of the packing 36.

The dust collection case 21 is controlled in the transverse movement by a guide not shown in the drawing which is attached to the base 45. However, the dust collection case 21 can slide forward along the guide. By doing this, the dust collection case 21 can be removed from the cleaning device 1. When the packing 36 installed at the back end of the dust collection case 21 presses the dust collection case 21 into the self-propelled cleaning device 1 up to the position where it makes contact with the suction body 30, a pawl 28 installed on the dust collection case is fit into a hollow 29 formed on the side of the cleaning device 1. By doing this, the movement of the dust collection case 21 in the forward direction can be controlled.

The pawl 28 is elastic and when dust collection case 21 is strongly pulled forward, the pawl 28 is dented down. And, the fitting between the pawl 28 and the hollow 29 on the side of the cleaning device 1 comes off and the dust collection case 21 can be easily removed from the cleaning device 1. The upper cover of the dust collection case 21 can be removed from the dust collection case 21. Therefore, when the dust collection case 21 is removed, dust collected in the dust collection case 21 can be easily discarded. Further, the dust collection case is removable, and the slideways between the dust collection case 21 and the suction body 30 are exposed, so that the slideways can be easily cleaned.

The suction body 30, to move in the transverse direction, has a suction body feed motor 32, an encoder 34 mounted to the motor 32, a ball screw 37 connected to the shaft of the motor 32, a suction body origin detection switch 90, and a support arm 42 for hanging and supporting the suction body 30 from above.

The suction body 30 is connected to the ball screw 37 via the support arm 43. The ball screw 37 is supported rotatably by bearings 35 held by support members 45*a* almost rigidly attached to the base 45. The connection part for connecting the support arm 42 to the ball screw 37 is a pin 43 and a female screw is cut on the inner surface thereof. When the ball screw 37 rotates, the suction body 30, the pin 43, and the support arm 42 move in the transverse direction.

The encoder 34 detects the movement amount of the pin 43 and outputs it to the controller 6. The suction body origin detection switch 90, when the pin 43 is within a predetermined range, is arranged so that the pin 43 is switched on. And, when the pin 43 is beyond the predetermined range, it is switched off. The ON and OFF switching position is set to the origin. When the origin detected by the suction body origin detection switch 90 and the output value of the encoder 34 are combined, the absolute value of the position of the support arm 42 is known. In this embodiment, the positional origin is decided by the mechanical method. However, needless to say, an optical sens or may be used.

On the support arm 42, a slider movable in the transverse direction is mounted. To return the slider 33 to the neutral position, the slider 33 has a spring 33*b*. When transverse force is applied to the suction body 30, the slider 33 moves according to the magnitude of the force. When the motor is rotated, the suction body 30 moves in the transverse direction by sliding between the dust collection case 21 and itself.

According to this embodiment, the tip of the suction body 30 is supported by the support arm 42 via the slider 33, so that the tip of the suction body 30 can reach the neighborhood of the wall. Further, when the projected tip of the suction body 30 makes contact with an external article such as the wall, the self-propelled cleaning device 1 can be prevented from changing the direction by the reaction force from the article. When the spring force of the slider 33 is made sufficiently weak, even if the projected tip of the suction body 30 make contact with an article, the suction body 30 and contact article can be prevented from damage.

In the neighborhood of the part of the suction body 30 projected from the self-propelled cleaning device 1, a contact detection sensor 44 is attached. The contact detection sensor 44 is composed of a plurality of switches arranged in a sheet shape and when the cleaning device 1 makes contact with the wall or an obstacle, the corresponding switch is pulled down. The contact detection sensor 44 outputs the contact position to the controller 6. By doing this, the contact detection sensor 44 can detect that the projected part of the suction body 30 makes contact with the wall or an article.

The operation of the self-propelled cleaning device 1 having such a constitution will be explained below. The self-propelled cleaning device 1 has two kinds of movement modes such as an automatic movement mode and a manual movement mode. In the automatic movement mode, the self-propelled cleaning device 1 executes automatic movement on the basis of information of various sensors loaded in the self-propelled cleaning device 1. In the manual movement mode, the self-propelled cleaning device 1 performs a single operation such as forwarding, backwarding, or rotation on the basis of a signal transmitted from the remote control transmitter 100.

At the start time of the self-propelled cleaning device 1, the manual movement mode is set. In the manual movement mode, a user instructs the moving direction of the cleaning device 1 using the remote control transmitter 100. Therefore, the user moves the cleaning device 1 to a room to be cleaned without setting the manual movement mode and lifting up the cleaning device 1, thus the physical burden imposed on the user can be lightened. During the operation in the manual mode, when he instructs the cleaning device 1 from the remote control transmitter 100 or the switch on the operation panel 46 of the cleaning device 1, the self-propelled cleaning device 1 is shifted to the automatic movement mode. In the automatic movement mode, on the basis of the algorithm stored in the controller 6 beforehand, the cleaning device 1 moves so as to clean throughout the whole room using the output of various sensors such as the infrared distance measuring sensors 10*a* to 10*c*.

By use of the self-propelled cleaning device 1 described in this embodiment, during the automatic movement, the neighborhood of the wall or an obstacle can be cleaned. Therefore, when cleaning the neighborhood of the wall, the self-propelled cleaning device 1 moves along the wall. During movement along the wall, a predetermined interval is kept between the self-propelled cleaning device 1 and the wall surface. The predetermined interval, when the suction body 30 is projected most, is smaller than the distance at which the suction body 30 makes contact with the wall.

The difference between the distance to the wall which is measured by the infrared distance measuring sensor 10*a* and the target distance is obtained. When the difference between the two distances is positive, the self-propelled cleaning device 1 is instructed to approach the wall. When the difference between the two distances is negative, the self-propelled cleaning device 1 is instructed to separate from the wall. Until the contact detection sensor 44 detects that the tip of the projected part of the suction body is in contact with the wall, the suction body 30 is projected. Or, on the basis of the distance from the self-propelled cleaning device 1 to the wall which is detected by the infrared distance measuring sensor 10*a*, the projection amount of the suction body 30 is decided. By the latter method, when the projection amount of the suction body 30 is adjusted, the neighborhood of the wall can be cleaned free of contact of the tip of the suction body 30 with the wall.

According to this embodiment, even if an article is caught by the front of the projected suction body 30 during movement, the contact detection sensor 44 can detect the object, so that the suction body is stored once in the self-propelled cleaning device 1, thus the cleaning can be continued by avoiding the obstacle.

Figure 4:
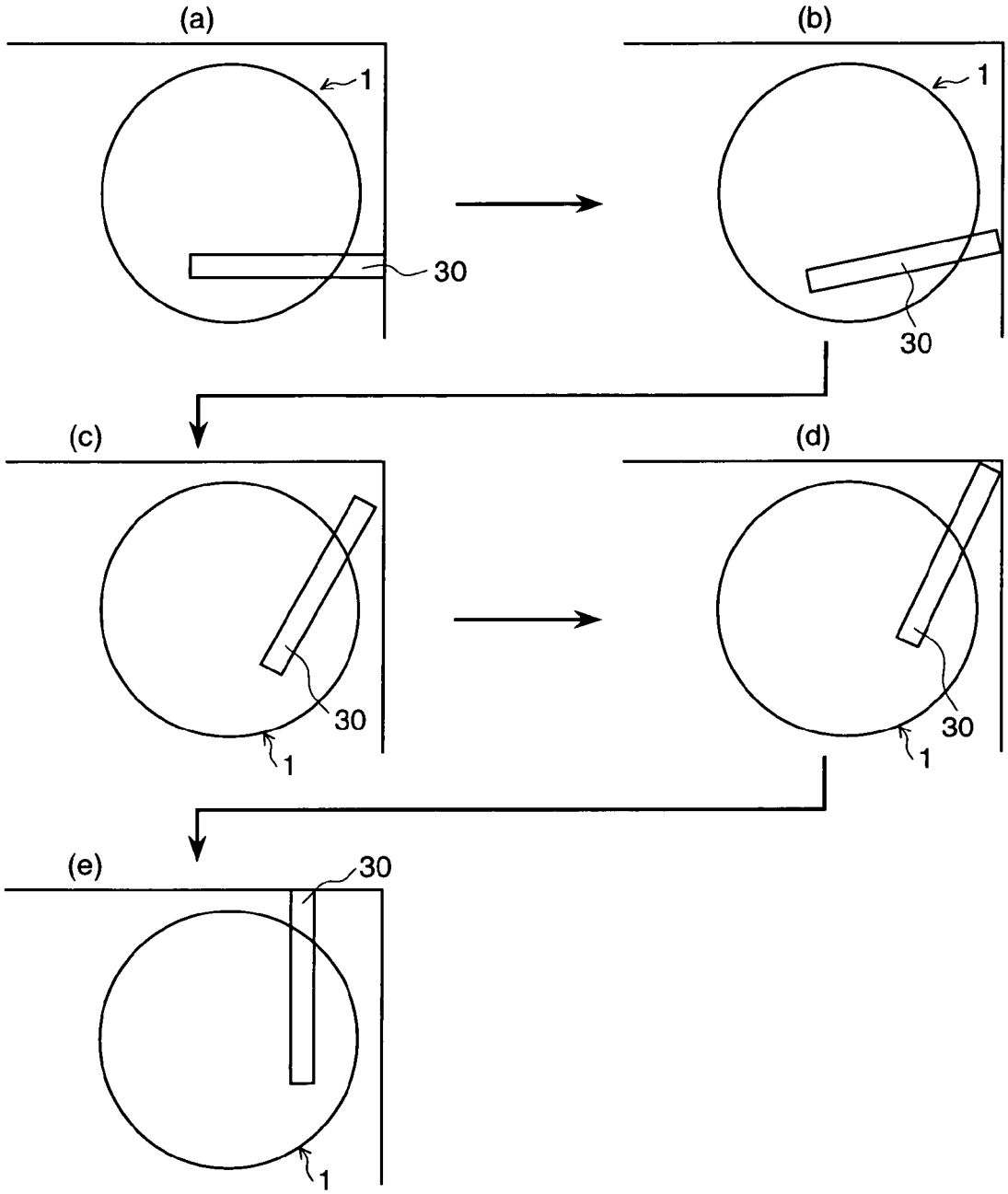
FIG. 4*a-e* is a drawing for explaining the cleaning method of the self-propelled cleaning device.

When cleaning the neighborhood of the wall, the self-propelled cleaning device 1 often must rotate in the corners of the room. FIG. 4 shows the situation of rotation of the self-propelled cleaning device 1. When the self-propelled cleaning device 1 reaches one corner of the room during moving along the wall in the automatic movement mode, the infrared distance measuring sensors 10*a* and 10*b* detect the wall. Then, the self-propelled cleaning device 1 is shifted to the operation of rotation in the place by cleaning the corner. At this time, when the projection amount of the suction body 30 is controlled so as to move the tip of the suction body 30 along the wall, the non-cleaned area of the corner can be reduced.

The projection amount of the suction body 30, similarly to the general movement along the wall, is decided on the basis of information of the contact detection sensor 44 or information of the distance from the self-propelled cleaning device 1 to the wall which is detected by the infrared distance measuring sensor 10*a*. The infrared distance measuring sensor 10*a* precedes the tip of the suction body 30 in the rotational direction (counterclockwise in FIG. 4) of the self-propelled cleaning device 1, so that the sensor can confirm the shape of the corner before the tip of the suction body 30 passes the corner. By doing this, in correspondence to the shape of the corner, the suction body 30 can be controlled not to make contact with the wall and to get as close to the wall as possible. Even if the wall is made of a material easily worn, no damage is caused to the wall. Further, when deciding the projection amount of the tip of the suction body 30, a program on the assumption that the corners of the room are right-angled may be used. In this case, the cleaning device 1 can be controlled simply.

The side cover 23 has a notch formed in the part wherefrom the suction body 30 is projected. By this notch, the suction body 30 can move smoothly. On the lower part of the front of the side cover 23, to remove the dust collection case 21, a hatch 26 which is opened by sliding vertically is provided.

On the base 45 in the neighborhood of the inner peripheral surface of the side cover 23, four springs 25*a* to 25*d* are mounted almost at even intervals. The springs 25*a* to 25*d* are made of a piano wire and they are hardly stretchable in the longitudinal direction but easily move in the bending direction. And, when the load is removed, the springs are returned. The springs 25*a* to 25*d* are arranged vertically. The springs 25*a* to 25*d* are shown in the partial cross sectional view in FIG. 5 in detail. At the upper end of the top cover 27, a step 27*a* bent inward is formed. The step 27*a* prevents the side cover 23 from moving downward. By the step 27*a*, even if downward force is applied to the side cover 23, the top cover 27 supports the force to prevent the springs 25*a* to 25*d* from buckling.

Further, by the step 27*a* of the top cover 27, the movable amount of the side cover 23 in the horizontal direction is restricted to about 3 mm. Furthermore, the springs 25*a* to 25*d* are hardly deformed by tensile strength, so that even if the side cover 23 of the self-propelled cleaning device 1 is lifted up, the side cover 23 will not be separated from the base 45.

Switches 24*a* to 24*d* for detecting the horizontal movement of the side cover 23 are arranged at a slight interval from the side cover 23. The switches 24*a* to 24*d* are held by the tips of brackets 72*a* to 72*d* installed perpendicularly to the base 45. When the side cover 23 moves in any direction in the horizontal direction, one or two switches 24*a* to 24*d* make contact with the side cover 23 and the switches 24*a* to 24*d* operate. Depending on which switch is operated among the switches 24*a* to 24*d*, the rough direction of an article can be known. The output of the switches 24*a* to 24*d* is outputted to the controller 6. Therefore, when the side of the cleaning device 1 makes contact with an article and the side cover 23 moves, the contact with the article can be detected.

According to this embodiment, the whole periphery of the side cover 23 is integrally formed and is softly supported by the springs and four contact switches are installed at a pitch of almost 90 degrees, so that even if the cleaning device 1 makes contact with an article at any position, there is no dead angle of detection. Further, the detection mechanism requires few parts and the structure is simple and inexpensive. The parts required for detection can be arranged in the neighborhood of the side cover 23 of the cleaning device 1, so that a space for other parts can be reserved in the central part of the self-propelled cleaning device 1. The side cover 23 is supported by the top cover 27, so that the structure is strong against external force in the vertical direction. The rough direction of an article can be known, so that an avoidance operation can be performed easily.

Further, only by changing the rigidity of the springs 25*a* to 25*d*, the detection sensitivity can be easily changed. When the horizontal clearance between the top cover 27 and the side cover 23 is changed, the horizontal movable range of the side cover 23 can be changed. When the rigidity of the springs 25*a* to 25*d* and the horizontal movable range are properly combined, soft-touch contact detection is made possible. In this setting, the self-propelled cleaning device 1 and its peripheral article can be prevented from making contact with each other and causing damage to each other.

In this embodiment, to support the side cover, the four springs 25*a* and 25*d* are used and to detect the movement, the four switches 24*a* to 24*d* are used. However, the number is not limited to 4. The number of the springs 25 and the number of the switches 24 may be different from each other. The switches are not limited to a rounded shape used in the aforementioned embodiment and may be a polyhedron having rounded angles. In any case, no dead angle is generated in detection.

To the suction body 30, a pressure sensor not shown in the Drawing is attached. The pressure detected by the pressure sensor is outputted to the controller 6. When the self-propelled cleaning device 1 is in use, a situation may be caused that the suction port 40 is blocked by paper and dust cannot be sucked in. At this time, the pressure in the suction body 30 is suddenly lowered. When this state is continued form many hours, the motor 20*a* for driving the dust collection fan 20 enters an overload state and the self-propelled cleaning device 1 fails. Then, the pressure sensor detects pressure changes in the suction body 30 and the overload state of the motor 20*a* is avoided.

Concretely, when the pressure sensor 13 detects a sudden pressure reduction, it stops the suction of the cleaning device 1 once. When the suction is stopped, the pressure in the suction body 30 becomes equal to the atmospheric pressure and the article attached to the suction port 40 can be removed easily. Next, the cleaning device 1 moves at a predetermined distance and then the article attached to the suction port 40 is removed. The suction is restarted, and it is confirmed that the pressure is returned to its normal pressure, and then the cleaning is restarted. When the pressure difference is not returned to the one in the normal state, the aforementioned suction stop and the movement of the cleaning device 1 are repeated. When the pressure is not returned to the normal pressure even if the above procedure is repeated by a predetermined number of times, the suction is stopped and the cleaning is stopped. To inform the user of an error, the indicator 47 indicates the error.

As dust is collected in the dust collection case 21, the pressure reduction in the suction body 30 in the suction state gets smaller. The pressure sensor monitors the pressure when the dust collection fan 20 is in operation, so that the collection state of dust in the dust collection case 21 can be detected. The dust collection state is indicated to the user by the indicator 47. Since the dust collection state can be detected, the dust removal timing from the dust collection case 21 can be known automatically.

The cleaning device 1 uses the storage battery 22 as a power source, so that the charging operation is required. Further, the capacity of the dust collection case 21 is limited, so that when a predetermined amount of dust is collected, it is necessary to remove dust from the dust collection case 21. In this embodiment, these operations are automatically performed by the cleaning device 1. This situation will be explained by referring to FIGS. 6 to 8.

Figure 6A:
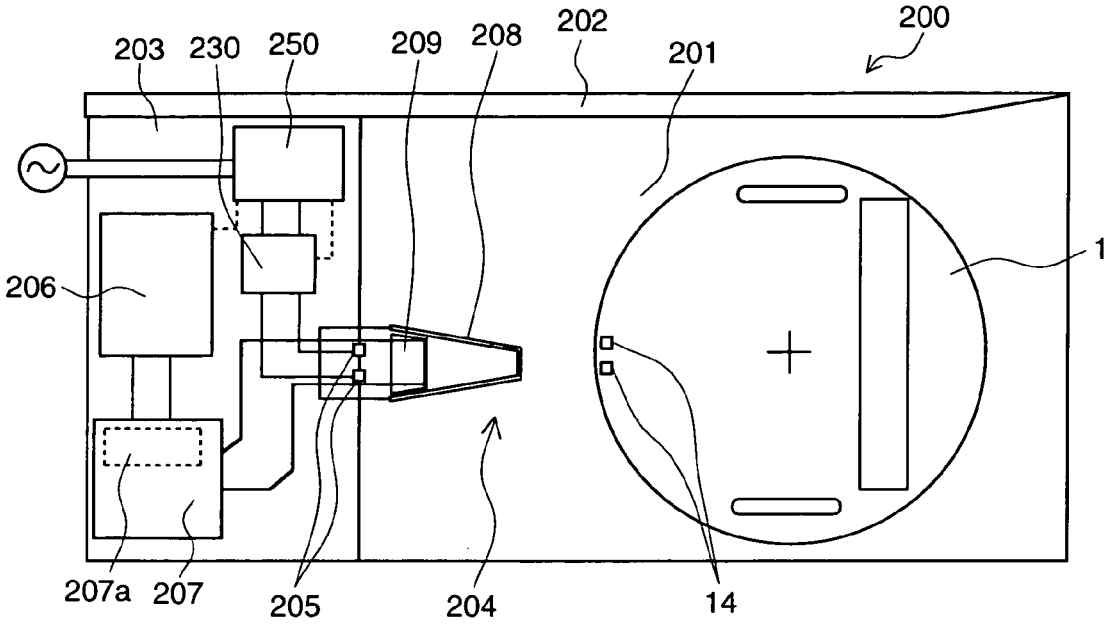
FIG. 6 is a top view and a side view of the main unit and charger of the self-propelled cleaning device shown in FIG. 1.
Figure 6B:
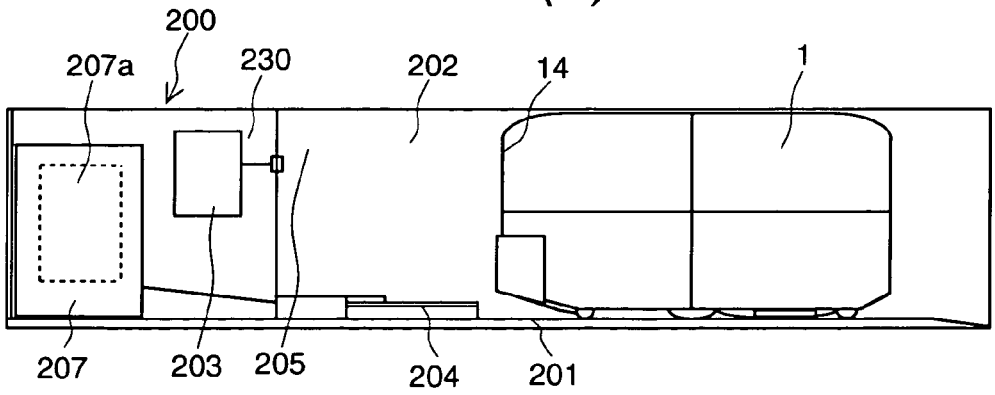
Figure 7A:
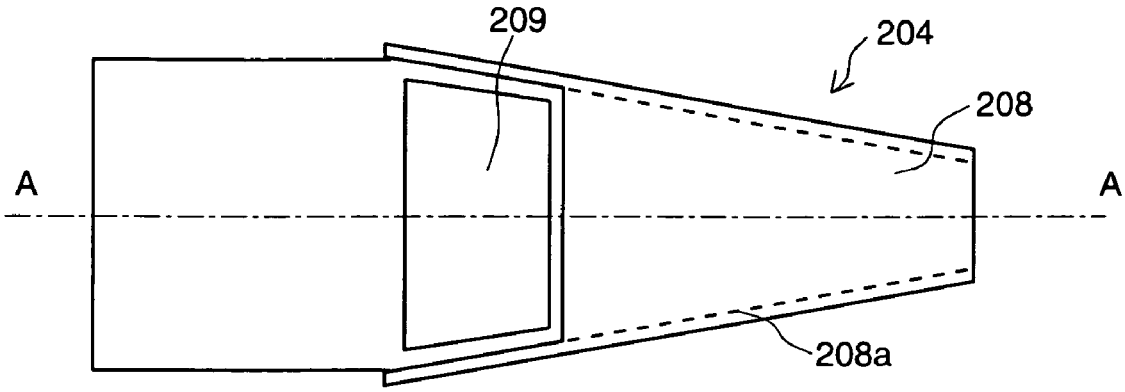
FIG. 7 is a top view and a front view of the guide of the self-propelled cleaning device shown in FIG. 1.
Figure 7B:
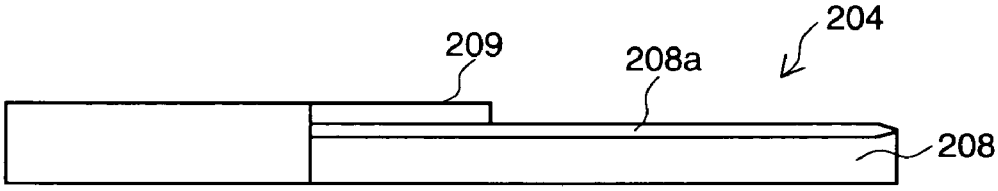
Figure 7C:
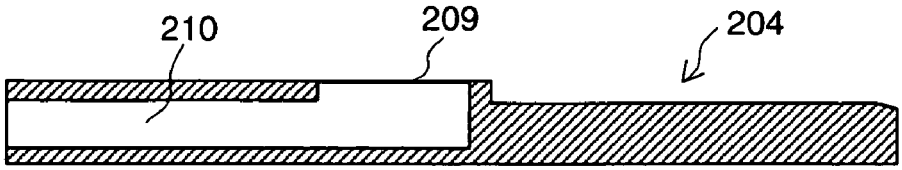

FIG. 6 is a schematic view of the self-propelled cleaning device 1 and a charger 200 installed in a corner of a room, and FIG. 6(*a*) is a top view thereof, and FIG. 6(*b*) is a side view thereof. The charger 200 has a lower plate 201, a side wall 202, a box 203, and a charger guide 204. FIG. 7 shows the charger guide in detail, and FIG. 7(*a*) is a top view thereof, FIG. 7(*b*) a side view, and FIG. 7(*c*) a cross sectional view along the line A-A shown in FIG. 7(*a*).

The box 203 is a power supply unit installed on the building side. The guide 204 is connected to the box 203 and is used, when charging the cleaning device 1, to smoothly connect to the contact of the cleaning device 1. On the end face of the box 203 on the side of the guide 204, charging terminals 205 are installed. The charging terminals 205 are electrically connected to a charging circuit 230 installed in the box 203. To the charging circuit 230, commercial power is supplied.

In the box 203, a charger dust collection fan 206, a charger dust collection case 207, and a charger controller 250. The charger dust collection case 207 has a larger dust collection capacity than that of the dust collection case 21 of the self-propelled cleaning device 1. The charger controller 250 monitors and controls the current and voltage supplied from the charging circuit 230 to the charging terminals 205 and controls the operation of the charger dust collection fan 206.

On the charger guide 204, a guide 208 getting narrower in width toward its tip and a trapezoidal dust suction port 209 surrounded by guide 208 are formed. At the edge of the top of the guide 208, a flange 208*a* is formed. The top of the dust suction port 209 is higher than the top of the guide 208. The dust suction port 209 is interconnected to the charger dust collection case 207 via a suction path 210 formed inside the guide.

When the charger dust collection fan 206 is operated, air is sucked in from the dust suction port 209. And, dust included in sucked air is separated by a filter 207*a* held in the charger dust collection case 207 and is collected in the charger dust collection case 207. By doing this, dust collected in the dust collection case 21 of the cleaning device 1 is moved to the dust collection case 207 on the side of the charger 200.

Figure 8A:
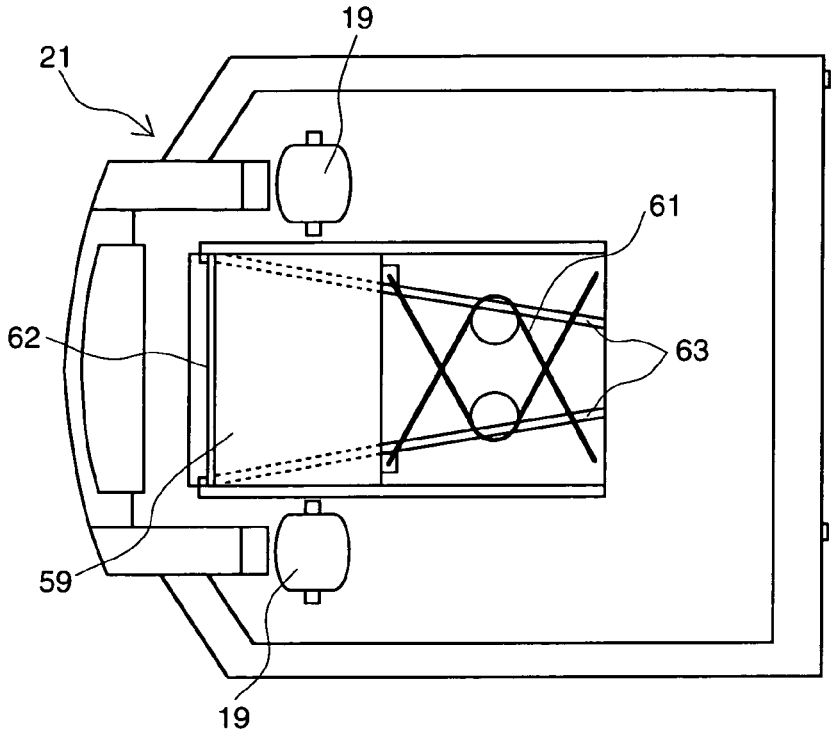
FIG. 8 is a bottom view of the self-propelled cleaning device shown in FIG. 1.
Figure 8B:
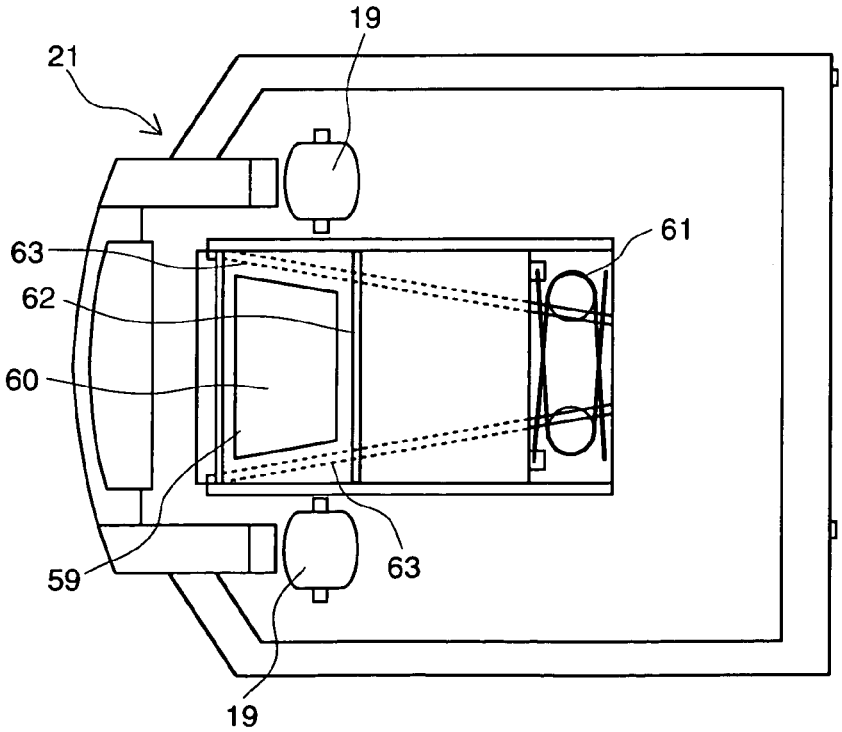

FIG. 8 shows the dust collection case 21 of the self-propelled cleaning device 1 in detail to which the guide 204 of the charger 200 shown in FIG. 7 is joined. FIG. 8 is a bottom view of the self-propelled cleaning device 1, and FIG. 8(*a*) shows a state that a shutter 59 installed on the bottom of the dust collection case 21 is closed, and FIG. 8(*b*) shows a state that it is opened.

On the bottom of the dust collection case 21, a dust ejection port 60 is formed and the dust ejection port 60 is covered with the shutter 59. The shutter 59 slides in the forward direction of the self-propelled cleaning device 1. On the back of the dust collection case 21, springs 61 are held and the springs 61 press the shutter 59 to the left. During the normal operation of the cleaning device 1, the dust ejection port 60 is covered with the shutter 59 and dust in the dust collection case 21 will not fall (refer to FIG. 8(*a*)).

When the shutter 59 is pressed to the right, the springs 61 are shrunk and the dust ejection port 60 appears as shown in FIG. 8(*b*). At the front edge of the shutter 59, a bending part 62 bending downward is formed. When joining the self-propelled cleaning device 1 to the charger 200, the lower end of the bending part 62 is set so as to be higher than the top of the charger guide 208 and lower than the edge of the dust suction port 209. On both sides of a dust ejection port 58, a guide 63 is installed. The guide 63 is in a relationship of male and female with the guide 208 of the charger 200. When joining the self-propelled cleaning device 1 to the charger 200, the heights of the guides 63 and 208 are set so that the height of the guide 63 coincides with the height of the guide 208. Further, when joining the guide 208 to the guide 63, the charging terminals 14 and 205 are set so that the charging terminal 205 makes contact with the charging terminal 14 of the cleaning device 1.

The dust ejection operation of the self-propelled cleaning device 1 having such a constitution will be explained below by referring to FIGS. 6 to 8. The side wall 202 of the charger 200 is installed beforehand in contact with the wall of the room. If the voltage of the storage battery 22 is lowered below a predetermined value when the self-propelled cleaning device 1 is in operation, the controller 6 judges that the residual charge of the battery is little. And, the controller 6 moves to the charging operation.

When the controller 6 moves to the charging operation, the self-propelled cleaning device 1 goes straight on and searches for the wall of the room. When the controller 6 judges that the cleaning device 1 reaches the wall from the output of the switches 24*a* to 24*d* of the side cover or of the contact detection sensor 44 of the suction body 30, the cleaning device 1 moves along the wall so that the wall is positioned on the right of the cleaning device 1. When the cleaning device 1 continues the movement along the wall and reaches the charger 200, it rides on the lower plate 201 along the side wall 202 of the charger 200.

During the movement along the side wall 202, the cleaning device 1 moves forward away from the wall by the distance decided on the basis of the distance from the guide 208 to the side wall 202. By doing this, when the self-propelled cleaning device 1 rides on the lower plate 201 of the charger 200, the guide 208 on the side of the charger 200 and the guide 63 on the side of the self-propelled cleaning device 1 are almost just opposite to each other.

When the self-propelled cleaning device 1 continues the movement along the side wall 202, the front wheels of the guide 63 on the side of the self-propelled cleaning device 1 are automatically fit into the tip of the guide 208 on the side of the charger 200. And, finally the two guides 208 and 63 cling to each other. At that time, the charging terminals 14 on the side of the self-propelled cleaning device 1 and the charging terminals 205 on the side of the charger 200 make contact with each other, and the power supply is started, and the storage battery 22 is charged.

When the self-propelled cleaning device 1 continues the movement along the side wall 202, the shutter 59 of the self-propelled cleaning device 1 is caught by the edge of the dust suction port 209 of the charger 200. Next, the shutter 59 is pressed and opened by the guide 204 and the dust suction port 209 and the dust ejection port 58 are just opposite to each other. When the controller 6 of the self-propelled cleaning device 1 detects that the contact terminals 14 and the charging terminals 205 on the side of the charger 200 are under current supply, it stops the movement of the cleaning device 1.

The charger controller 250 detects the current flowing in the charging terminals 205 and judges that the self-propelled cleaning device 1 is joined to the charger 200. The controller 250 operates the charger dust collection fan 206 for a predetermined time and sucks in dust from the dust collection case 21 of the self-propelled cleaning device 1 in to the charger dust collection case 207. The suction is continued for a predetermined time.

When the charger controller 250 or the controller 6 of the self-propelled cleaning device 1 judges the end of the dust suction and then judges the completion of charging of the storage battery 22, the self-propelled cleaning device moves backward. And, the charging terminals 208 on the side of the charger 200 and the charging terminals 14 on the self-propelled cleaning device side are separated from each other. Or, using the controller 6 of the self-propelled cleaning device 1 or the charger controller 250, the voltage application to the storage battery 22 is stopped. Since both charging and dust ejection are finished, the cleaning is restarted when necessary.

According to this embodiment, dust in the dust collection case 21 which is conventionally discarded by hand is moved to the dust collection case 207 on the side of the charger 200, so that the capacity of the dust collection case 21 on the side of the cleaning device 1 which requires a large capacity for automatic cleaning can be reduced. By doing this, the cleaning device can be miniaturized. Further, in the aforementioned embodiment, dust is separated using a filter. However, the centrifugal method used in an electric cleaning device may be used.

Further, according to this embodiment, without loading a large capacity storage battery and dust collection case, the cleaning can be carried out in a wide area or for many hours. Since a physical guide is used, an automatic charging and dust ejection system having a simple structure and high sureness can be realized.

Figure 9A:
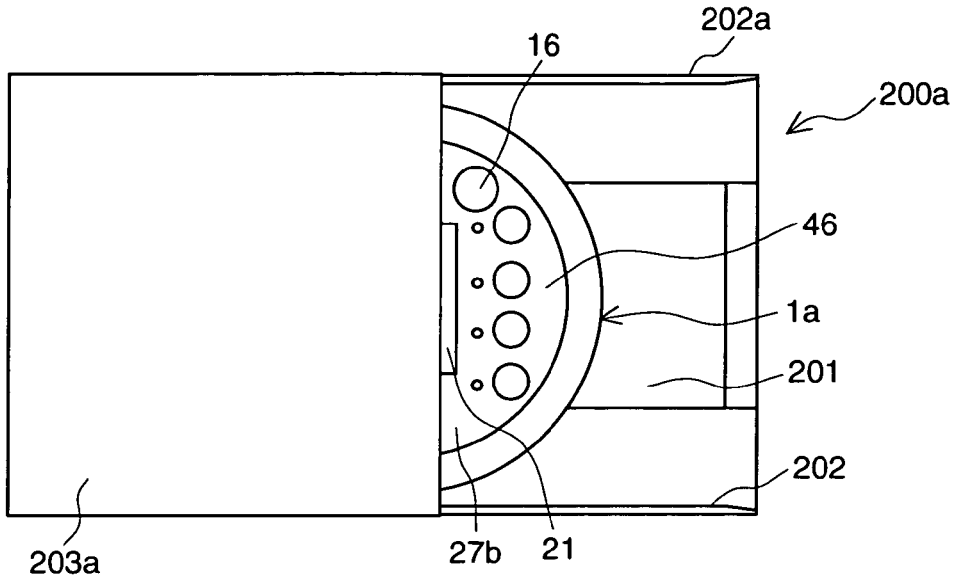
FIG. 9 is a top view and a side view of another embodiment of the self-propelled cleaning device relating to the present invention.
Figure 9B:
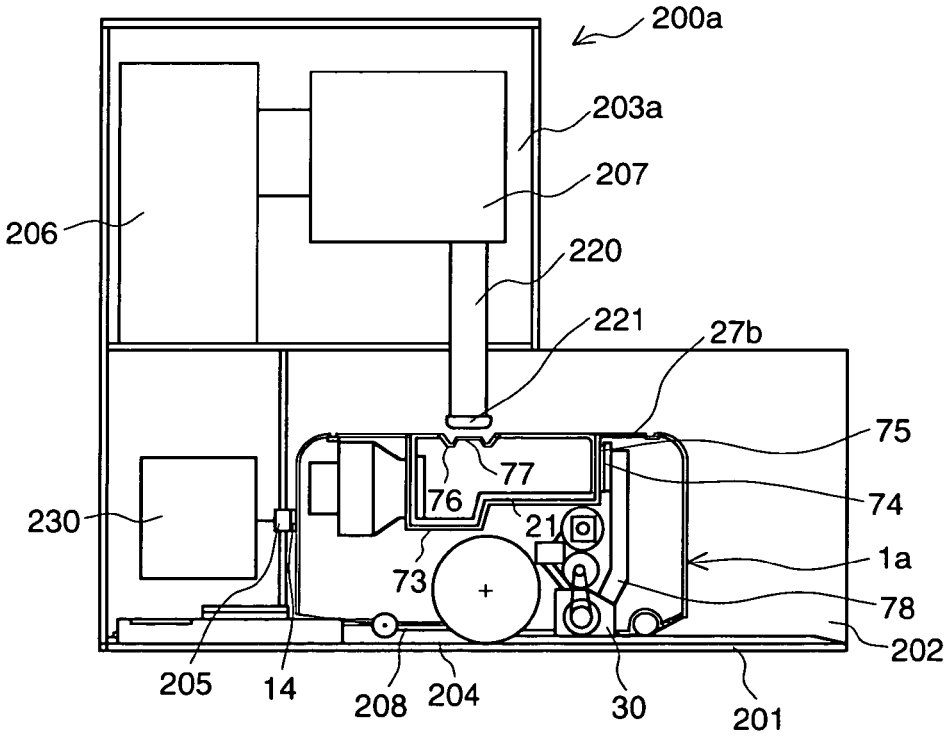

Another embodiment of the present invention is shown in FIG. 9. In the aforementioned embodiment, the dust collection case is arranged on the lower part of the cleaning device. In this embodiment, the dust collection case is arranged on the upper part of the cleaning device. Therefore, the dust collecting means installed on the charger side is different from that in the aforementioned embodiment. FIG. 9 shows a state that a cleaning device 1*a* is stored in a charger 200*a*, and FIG. 9(*a*) is a top view thereof, and FIG. 9(*b*) is a side cross sectional view thereof.

A dust collection case 21*a* of the cleaning device 1*a* is held by a dust collection case holder 73 installed on a top cover 27*b*. On the top of the dust collection case 21*a*, a check valve 77 is installed and around the check valve 77, a tapered mouthpiece 76 which is depressed viewed from the outside is formed. The mouthpiece 76 is made of a ferromagnetic material such as iron. The top of the dust collection case 21*a* is made of a transparent resin except the mouthpiece 76 and the check valve 77.

The suction body 30, similarly to the aforementioned embodiment, can move in the transverse direction. The suction body 30 and the dust collection case 21*a* are connected by a duct 78 extending vertically. At the upper end of the duct 78, a sliding plate 74 is mounted. The sliding plate 74 can slide on a packing 75 attached to the dust collection case holder 73. The guide 63 attached to the bottom of the dust collection case 21 in the aforementioned embodiment is attached to the bottom of the cleaning device 1*a*. However, the shutter 59 and the dust ejection port 60 arranged around the guide 63 are not required in this embodiment.

Also in this embodiment, the constitution of the charger 200*a* is the same as that in the aforementioned embodiment, though only a side plate 202*a* and a box 203*a* are different from those of the aforementioned embodiment. The box 203*a* is positioned above the side plate 202*a* and is positioned so as to cover only almost the half front of the cleaning device 1*a* when the cleaning device 1*a* is connected to the charger 200*a*. A flexible hose 220 is extended from the charger dust collection fan 206 and the hose 220 sucks in dust.

At the tip of the hose 220, an electromagnet 221 is mounted and it enables the charger controller 250 to control the current. The tip of the hose 220 is pulled out outside the box 203*a* and when the cleaning device 1*a* is positioned at the charging position, the mouthpiece 76 is positioned right under the tip of the hose 220. A guide 204 of the charger 200*a* is the same as that of the aforementioned embodiment.

The operation of this embodiment having such a constitution will be explained below. Until the cleaning device 1*a* is connected to the charger 200*a*, the state is the same as that of the aforementioned embodiment. When the charger 200*a* is connected to the cleaning device 1*a*, the cleaning device 1*a* stops the movement. The charger 200*a* detects that the charging terminals 14 on the side of the cleaning device 1*a* and the charging terminals 205 on the charger side make contact with each other and starts charging.

The charger controller 250 starts power supply to the electromagnet 221 at the tip of the hose 220. The electromagnetic 221 is magnetized and an attractive force is applied between the magnet and the ferromagnetic mouthpiece 76. The flexible hose 220 is extended and the tip of the hose 220 is connected to the mouthpiece 76. At this time, the electromagnet 221 and the mouthpiece 76 surely cling close to each other due to a tapered fitting structure.

The charger dust collection fan 206 is operated and the check valve 77 is opened by the generated pressure. Dust in the dust collection case 21*a* is sucked into the charger dust collection case 207. When the charger dust collection fan 206 is operated for a predetermined time, the power supply to the electromagnet 221 is stopped. By the elasticity of the hose 220, the tip of the hose 220 is separated from the mouthpiece 76. Then, the ejection of dust from the dust collection case 21 is finished. The subsequent operation is the same as that of the aforementioned embodiment.

According to this embodiment, the side walls 202*a* are installed on both sides of the charger 200*a*, so that the cleaning device 1 is prevented from entering into the charger 200*a* from the side of the charger 200*a*. The dust collection case 21 is installed on the top of the main unit and is made of a transparent resin, so that the dust amount in the dust collection case 21 can be confirmed visually. Further, a situation can be prevented that an article of value is sucked in and is discarded together with dust by mistake. The box 203*a* is structured so as to be high longitudinally, so that the occupied floor area of the charger 200*a* can be reduced. The box 203*a* covers only the front of the cleaning device 1*a*, so that the operation panel 46 and the infrared remote control receiver 16 which are arranged behind the cleaning device 1*a* can be exposed. As a result, even if the cleaning device 1*a* is stored in the charger 200*a*, it can be easily operated or remote-controlled.

Figure 10:
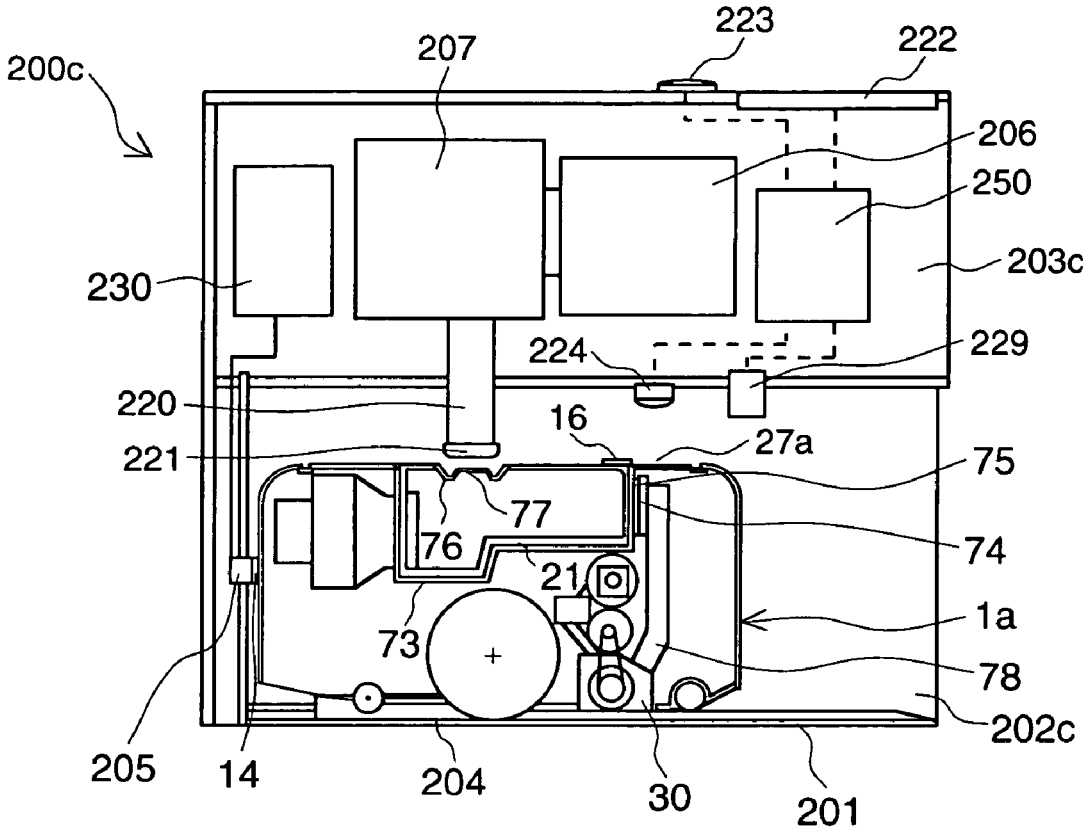
FIG. 10 is a side view of a modification of the self-propelled cleaning device shown in FIG. 9.

A modification of this embodiment is shown in FIG. 10. FIG. 10 is a side cross sectional view of the cleaning device 1*a* and a charger 200*c*. Also in this embodiment, similarly to the aforementioned embodiment, a box 203*c* is positioned above a side plate 202*c*, though it is different that the box 203*c* is positioned above the whole side plate 202*c*.

On the top of the charger 200*c*, an operation panel 222 and an infrared remote control receiver 223 which are installed in the cleaning device 1*a* are installed. The output of the operation panel 220 and the infrared remote control receiver 223 is input to the controller 250 installed in the box 203*c*. On the bottom of the box 203*c*, an infrared remote control transmitter 224 is installed. The transmitter 224 receives an instruction from the controller 250 and transmits a remote control signal in the charger 200*c*. On the upper part of the inner surface of the part where the self-propelled cleaning device 1 is stored, an entry detection sensor 229 for detecting the entry of the self-propelled cleaning device 1 into the charger 200*c* is installed and the output of the sensor is input to the controller 250.

When the switch on the operation panel 222 is pressed or when the infrared remote control receiver 223 receives a signal from an infrared remote control transmitter not shown in the drawing, the infrared remote control transmitter 224 transmits the corresponding signal to the remote control receiver 16 of the cleaning device 1*a*. By doing this, even if the cleaning device 1*a* is stored in the charger 200*c*, the cleaning device 1*a* can be operated. Further, the whole upper part of the charger 200*c* is the box 203*c*, so that the charger 200*c* can be made compactor.

When the entry detection sensor 229 detects that the self-propelled cleaning device 1*a* enters into the charger 200*c*, the controller 250 instructs the cleaning device 1*a* to transmit a signal indicating the entry of the cleaning device 1*a* into the charger 200*c* from the infrared remote control transmitter 224. By doing this, even if the cleaning device 1*a* enters the charger 200*c* unexpectedly during movement, the cleaning device 1*a* can change its way before it joins to the charger 200*c*.

Further, when the cleaning devices 1*a* does not enter into the charger 200*c*, the entry detection sensor 229 is not operated, so that it is found that the cleaning devices 1*a* is not in the charger 200*c* and the moving speed can be increased. As a result, when joining the cleaning device 1*a* to the charger 200*c*, the cleaning device 1*a* moves to the neighborhood of the charger 200*c* at high speed, and the moving speed is decreased in the neighborhood of the charger 200*c*, thus the cleaning device 1*a* can reach the charger 200*c* quickly. As a result, before the cleaning device 1*a* reaches the charger 200*c*, the moving speed can be increased and after it reaches the charger 200*c*, the moving speed can be decreased, so that the efficiency of the cleaning can be improved and the charging and dust ejection operation can be performed surely.

Further, if the position of the infrared remote control transmitter 224 and the shape of the side plate 202 are decided so as to prevent a signal transmitted from the infrared remote control transmitter 224 from leaking outside the charger 200*c*, the entry detection sensor 229 may be omitted. In this case, a signal indicating entry may be always transmitted from the infrared remote control transmitter 224.

According to the present invention, the suction body is made movable and the side cover can detect the direction of an obstacle, so that every corner of a room can be automatically cleaned. Further, the guide and dust ejection means are installed in the charger, so that the charging and dust ejection can be executed without hand and the automatic cleaning by the self-propelled cleaning device can be realized. Simultaneously, the cleaning for many hours or in a wide area can be realized. Furthermore, the self-propelled cleaning device can be miniaturized.

What is claimed is:

1. A charger for a self-propelled cleaning device comprising:

power supply means for supplying power from a commercial power source, to be provided to a power source provided in said self-propelled cleaning device, a first contact for electrically connecting said power supply means with a second contact provided in said self-propelling cleaning device, guide means for guiding movement of said self-propelled cleaning device, to connect said second contact of said self-propelled cleaning device to said first contact, and suction means and dust collection means for removing dust collected in a dust collection case carried by said self-propelled cleaning device, wherein said guide means forms a dust suction port which communicates to said dust collecting means, and opposes to a dust ejection port of said duct collection case.

2. A charger for a self-propelled cleaning device according to claim 1, further comprising control means for controlling said suction means, wherein said control means controls said suction means so as to operate when said power supply of said charger means is in operation.

3. A charger for a self-propelled cleaning device according to claim 1, further comprising:

a storage unit for storing said self-propelled cleaning device, means for detecting entry of said self-propelled cleaning device into said storage unit, and notifying means for notifying said entry to said self-propelled cleaning device.

* * * * *